US005149154A

United States Patent [19]

Shaanan

[11] Patent Number: 5,149,154

[45] Date of Patent: Sep. 22, 1992

[54] DOOR LATCH

[75] Inventor: Gad Shaanan, Montreal, Canada

[73] Assignee: Ideal Security Inc., LaSalle, Canada

[21] Appl. No.: 826,471

[22] Filed: Jan. 27, 1992

[51] Int. Cl.[5] ..... E05C 3/08

[52] U.S. Cl. ..... 292/226; 292/200

[58] Field of Search ..... 292/226, 217, 200, 126

[56] References Cited

U.S. PATENT DOCUMENTS

| | | | |
|---|---|---|---|
| 2,163,957 | 6/1939 | Murrin | 292/226 |
| 2,924,478 | 2/1960 | Wartian | 292/226 |
| 3,009,724 | 11/1961 | Hall | 292/226 |
| 3,044,816 | 7/1962 | Nazurian | 292/226 |
| 3,677,591 | 7/1972 | Waldo | 292/226 |
| 3,955,839 | 5/1976 | Praska et al. | 292/226 |
| 4,864,835 | 9/1989 | Wartian | 292/226 |

*Primary Examiner*—Eric K. Nicholson
*Attorney, Agent, or Firm*—Samuel Meerkreebs

[57] ABSTRACT

A rivetless door latch having a housing with a latch bolt having a pair of side plates and pivot pins seated in pivot sockets in the top of the housing and a lever with a dog leg having pivot pins seated in the pivot sockets in the base of the housing. The side plates of the latch bolt have a camming recess adapted to be engaged by camming projections on the dog leg of the lever. A leaf spring is anchored in the base of the housing and urges against the dog leg in a counterclockwise direction.

5 Claims, 2 Drawing Sheets

DOOR LATCH

BACKGROUND OF THE INVENTION

1. Field of the Invention

The present invention relates to door latches, and more particularly, to door latches mounted to the exterior of a door.

2. Description of the Prior Art

U.S. Pat. No. 3,955,839, issued May 11, 1976 to Praska et al, describes a door latch of the type used on storm doors to lock the door against the door jamb. This type of door latch includes a pivoting latch bolt activated by a lever handle on one side of the door. The purpose of the Praska et al invention was to provide a latch structure which avoided fasteners such as nuts and bolts, rivets, etc. Instead, moving parts and pivots were ingeniously designed to avoid such fasteners and particularly rivets in the manufacture of the door latch as contributing disproportionately to the manufacturing cost thereof.

SUMMARY OF THE INVENTION

The aim of the present invention is to provide a similar latch, that is, which avoids rivets and similar fasteners but which is a different structure, and in some ways an improvement over the Praska et al door latch.

It is an aim of the present invention to provide a door latch which is more simple to assemble than the prior art latches as represented by U.S. Pat. No. 3,955,839.

A construction in accordance with the present invention comprises a door latch having a onepiece housing including side walls, a top bight portion, and a separate base cover to close the housing at the base thereof. The housing defines a front opening and a rear opening. At least a pivot socket is provided at the top portion of the housing adjacent the bight, the pivot socket being open towards the bottom. A latch bolt including at least a pivot member is arranged in the housing with the pivot member in the pivot socket, wherein the latch bolt is adapted to pivot between an extended position projecting from the housing through the front opening and a retracted position within the housing. The latch bolt has at least a web member extending away from the pivot member towards the bottom and parallel to the housing side walls and a first camming recess defined in the web. The base cover includes at least a pivot socket means open towards the bight of the housing. The lever includes a dog leg member and a handle. The dog leg member includes a first pivot member adapted to be seated in the pivot socket in the base cover and a camming member on the dog leg spaced upwardly from the first pivot member and adapted to engage the recess defined in the web of the latch bolt. The handle extends through the rear opening of the housing such that when the handle is pivoted in a clockwise manner, the camming member on the dog leg will be engaged in the recess of the web and will cause the latch bolt to pivot counterclockwise to retract within the housing, and a spring means is located in the housing to return the latch bolt to an extended position.

Thus, the door latch of the present invention provides a simple structure which is easy to assemble and which can be easily mounted on a shutting stile of a door such as a storm door. The latch bolt is meant to engage a suitable strike rod or "Z" bar on the door jamb.

In a more specific embodiment, a spindle extends from the base cover towards the bight of the housing and includes a pair of diametrically opposed ears adapted to engage, when rotated, a spindle engagement member on the latch bolt, which will cause the latch bolt to rotate counterclockwise to thus retract the latch bolt within the housing and thus release the latch bolt from the strike member. The spindle may be connected to a door knob on the other side of the door shutting stile.

The spring means may be a simple leaf spring inserted through the base cover and anchored there. The leaf spring urges against a suitable spring engaging member on the dog leg portion of the lever. Such an arrangement is simpler and easier to assemble than the coil spring described in U.S. Pat. No. 3,955,839, which is also vulnerable and can be accidentally removed.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 2:
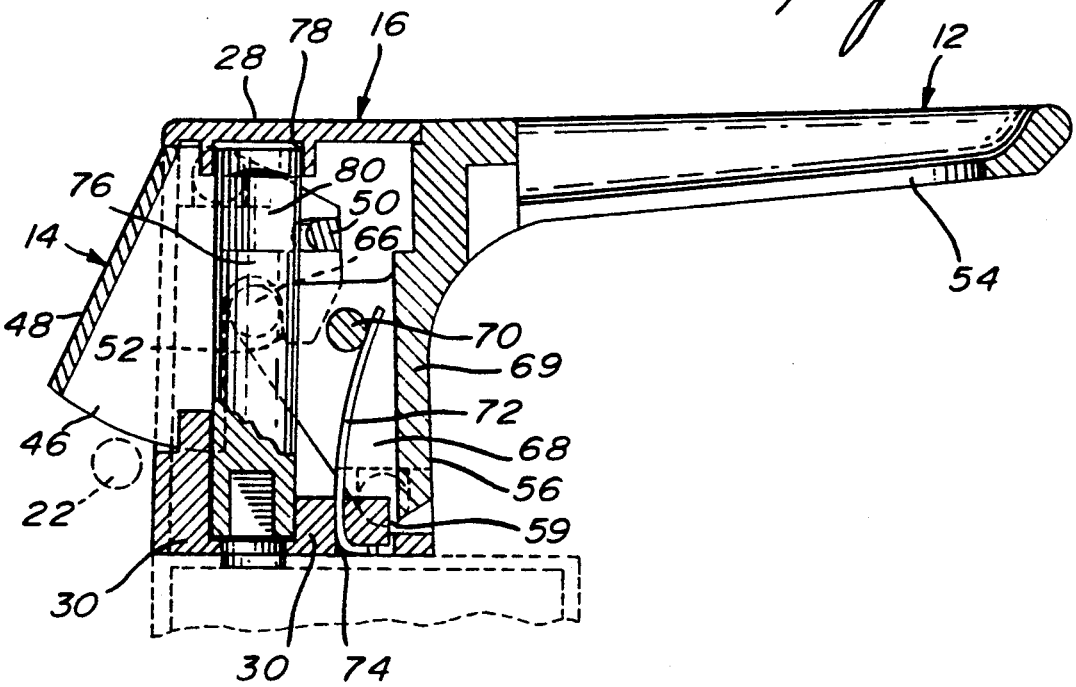
FIG. 2 is a vertical longitudinal cross- o section, taken through the door latch of FIG. 1.
Figure 1:
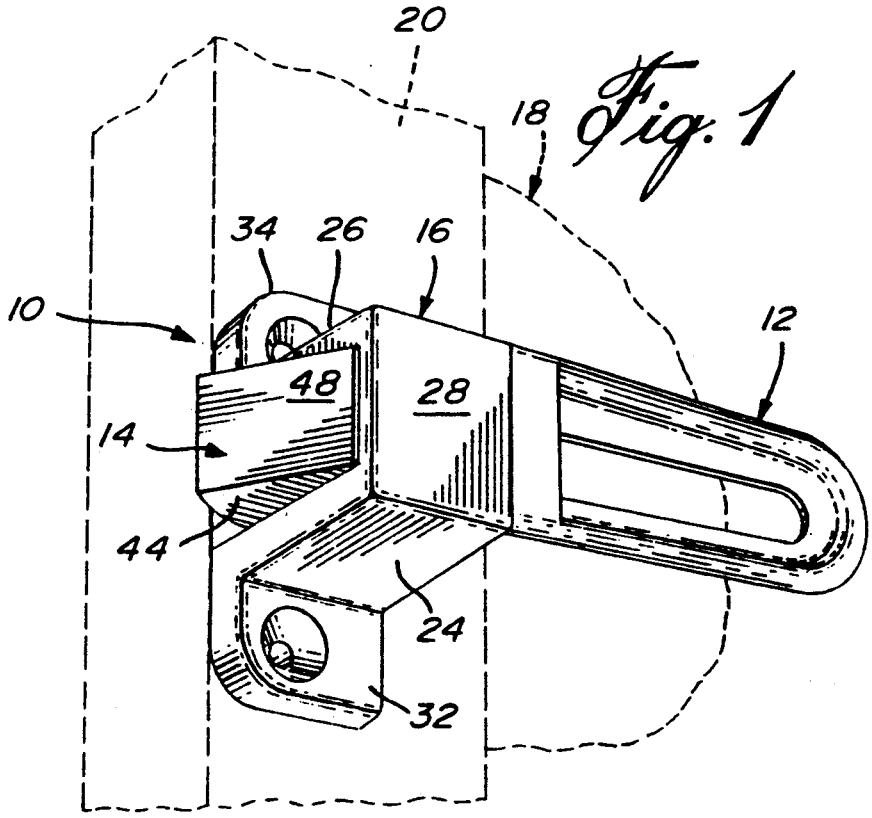
FIG. 1 is a perspective view of a door latch in accordance with the present invention.

As shown in the drawings, there is a door latch 10 adapted to be mounted on a shutting stile 20 of a door 18. The door latch 10, as shown in FIG. 1, includes a lever 12 and a latch bolt 14 mounted in a housing 16. The latch bolt 14 engages, in one direction, against a strike rod 22 shown in FIGS. 2 and 3, which would be mounted to a door jamb (not shown). On these types of doors, the latch bolt 14 is meant to be retracted into the housing 16 when it engages the strike rod 22 and to pop back to its extended position as shown in FIG. 2 when the door is closed against the jamb and the latch bolt 14 has passed the strike rod 22, thereby securing the door against the jamb.

There are three moving parts in the door latch 16, and these are identified generally as the lever 12, the latch bolt 14, and the spindle 76.

Figure 5:
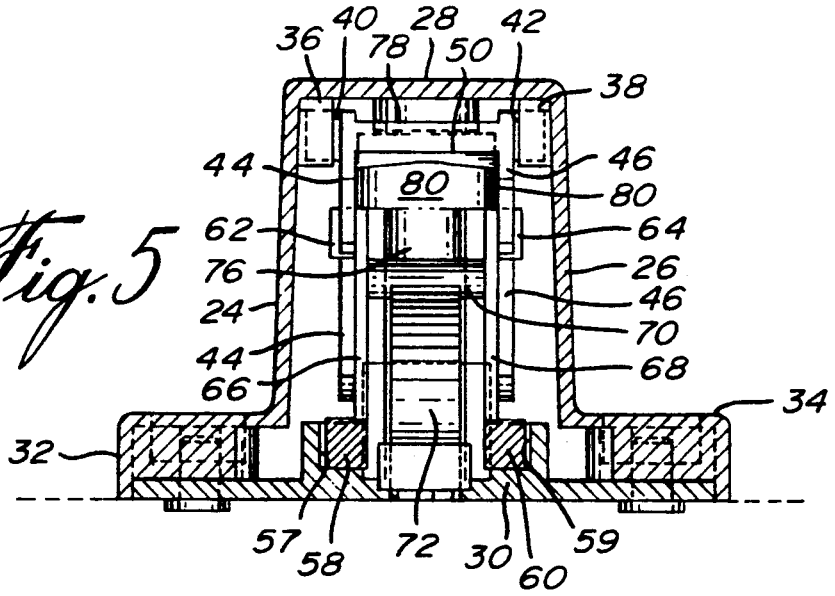
FIG. 5 is a vertical lateral cross-section, taken along line 5—5 of FIG. 3.
Figure 3:
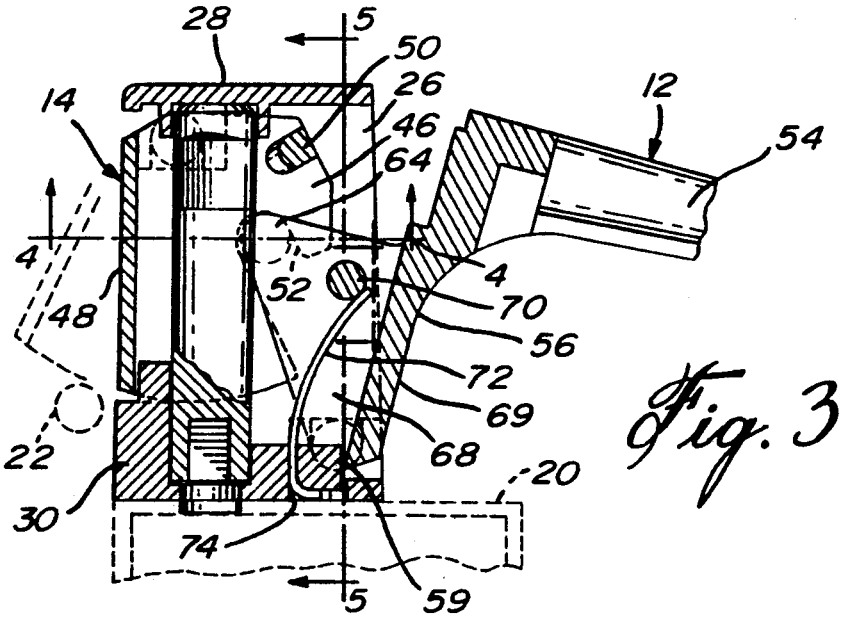
FIG. 3 is a fragmentary vertical longitudinal cross-section, similar to FIG. 2, showing the door latch in a different operative position.

The housing 16 includes a pair of parallel housing side walls 24 and 26 connected by a bight portion 28. The housing defines front and rear openings. Lateral projections 32 and 34 extend from the side walls 24 and 26 respectively. Screw holes may be provided in these projections in order to mount the latch bolt to the shutting stile 20 of the door. A cover base 30 closes the bottom of the housing 16. The cover base 30 is illustrated in FIGS. 2, 3, and 5. This cover base may be staked to the side walls of the housing 16. Housing 16 is preferably a one-piece metal casting.

Figure 4:
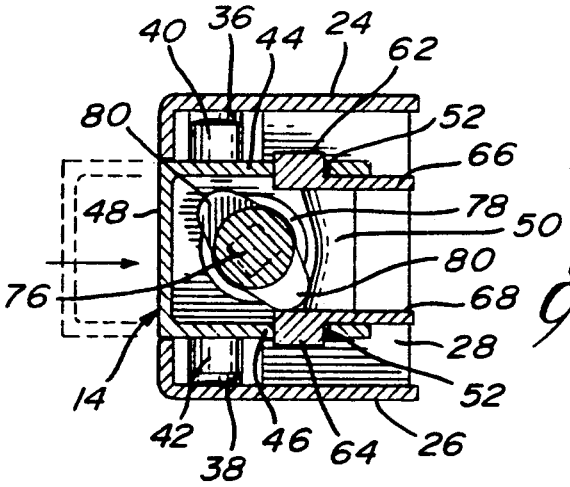
FIG. 4 is a horizontal cross-section, taken along line 4—4 of FIG. 3.

Within the housing 16 the bight portion is provided with a pair of pivot sockets 36 and 38 cast in the juncture between the side walls 24, 26 and the bight 28. These pivot sockets 36 and 38 each have a semi-circular seat and are open towards the base cover 30. The latch bolt 14 includes a pair of side plates 44, 46 and a front plate 48. Pivot pins 38 and 40 are mounted to the side plates 44 and 46 respectively. These pivot pins are adapted to sit in the sockets 36 and 38, as shown in FIGS. 4 and 5. A bridge bar 50 extends between the side plates 44 and 46 while a pair of identical camming recesses are defined in the side walls 44 and 46 respectively.

The lever 12 includes a lever handle 50 and a dog leg 56. The dog leg includes side plates 66 and 68 and a rear plate 69. Pivot pins 58 and 60 are mounted respectively to the side plates 66 and 68. A pair of pivot sockets 57 and 59 are defined in the base cover 30. These pivot sockets 57 and 59 are semicylindrical in configuration and are open towards the bight 28 of the housing 16. Pivot pins 58 and 60 sit in pivot sockets 57 and 59 respectively. The side plates 66 and 68 of the dog leg 56 mount camming projections 62 and 64 respectively, and these are adapted to engage the recesses 52 of the side plates 44 and 46 of the latch bolt 14. A bridge bar 70 extends between the side plates 66 and 68 of the dog leg 56, and a leaf spring 72 which passes through a slot 74 in the base cover 30 engages the bridge bar 70.

A spindle 76 extends through the housing and is seated in the cover 30 as well as in a socket 78 provided in the bight 28 of the housing 16.

Diametrically extending ears 80 are provided in the top portion of the spindle 76 and are adapted to engage the bridge bar 50 extending between the side plates 44 and 46 of the latch bolt 14. The spindle 76 may be connected to a typical door knob on the other side of the shutting stile 20.

In operation, the door latch 10 will be assumed to be in a closed position, as shown in FIG. 2. By depressing handle 54, of lever 12, clockwise, the lever 12 will pivot about the axis of pivot pins 58 and 60, causing the bridge bar 70 to move against the leaf spring 72 and the camming pins 64 and 66 within the recesses 52 of the latch bolt 14 to rotate the latch bolt 14 in a counterclockwise movement about the axis of the pins 40 and 42 in sockets 36 and 38. This causes the latch bolt to completely retract within the housing 16, thereby allowing the door to be opened past the strike rod 22.

By releasing the handle 54, the spring 72 will cause the lever 12 to rotate in a counterclockwise direction, thus forcing the latch bolt 14 to extend from the housing to its original position, as shown in FIG. 2. The latch bolt can also be operated by a knob (not shown) which will rotate the spindle 76 about its axis. The ears 80 will engage the bridge bar 50, extending between the plates 44 and 46 of the latch bolt 14, causing the latch bolt 14 to rotate about the axis of the pivot pins 40 and 42 in a counterclockwise direction. The release of the door knob will allow the leaf spring 72 to return the latch bolt 14 to its extended position and the spindle to its rest position.

As can be seen from the drawings, the latch bolt 14 is merely seated within the open sockets 36 and 38 while the lever 12 is seated in open sockets 57 and 59. However, the two pivoting elements are maintained in equilibrium within the housing 16 by the interconnection of the camming projections 64 and 66 within the recess 52 of the side walls 44 and 46 of the latch bolt 14. By removing the cover 30 from the housing 16, the various elements are immediately rendered inoperative and can be removed by removing the lever 12 first and then the spindle and then the latch bolt 14. The parts can be easily assembled in the reverse sequence.

I claim:

1. A door latch comprising a housing, including side walls, a top bight portion, and a separate base member, the housing defining a front opening and a rear opening, at least a pivot socket provided at the top portion of the housing adjacent the bight, the pivot socket being opened towards the bottom; a latch bolt including at least a pivot member is arranged in the housing with the pivot member in the pivot socket, wherein the latch bolt is adapted to pivot between an extended position projecting from the housing through the front opening and a retracted position within the housing, the latch bolt having at least a web member extending away from the pivot member towards the bottom and parallel to the housing side walls, and a first camming recess defined in the web; the base member including at least a pivot socket means open towards the bight of the housing, a lever having a dog leg member and a handle, the dog leg member including at least a first pivot member adapted to be seated in the pivot socket on the base member and at least a camming projection on the dog leg spaced upwardly from the first pivot member and adapted to engage the camming recess defined in the web of the latch bolt; the lever including a handle extending through the rear opening of the housing such that when the handle is pivoted in a clockwise manner, the camming projection on the dog leg, engaged in the recess of the web, will cause the latch bolt to pivot counterclockwise to retract within the housing, and spring means are located in the housing to return the latch bolt to an extended position.

2. A door latch as defined in claim 1, wherein a spindle extends through the housing and is adapted to engage the latch bolt such that when the spindle is rotated, it will retract the latch bolt, and when it is released, the latch bolt will extend from the housing on urging of the spring means.

3. A door latch as defined in claim 2, wherein the latch bolt has a U-shaped configuration with a pair of side plates and a front plate, the pivot socket adjacent the bight of the housing including a pair of spaced-apart open sockets adapted to receive pivot pins extending from the sides of the side plates, and the side plates being the web and defining the camming recesses for receiving camming projections of the dog leg, and a bar extends between the side plates of the latch bolt to be engaged by the pair of diametrically opposed ears on the spindle.

4. A door latch as defined in claim 3, wherein the dog leg is provided with a pair of spaced-apart side plates which are adapted to nest with the side plates of the latch bolt, and each of the side plates of the dog leg include pivot pin means adapted to be seated in a pair of corresponding pivot sockets in the base member, and the camming projections extend from the side walls of the dog leg to engage the recesses in the respective side walls of the latch bolt.

5. A door latch as defined in claim 4, wherein a bar extends between the side plates of the dog leg and the spring means is in the form of a leaf spring anchored in the base and urging against the bar extending between the side plates of the dog leg in order to urge the lever to rotate in a counterclockwise direction.

* * * * *